US009027803B2

(12) United States Patent
Presser

(10) Patent No.: US 9,027,803 B2
(45) Date of Patent: May 12, 2015

(54) FRICTION REDUCING ELEMENTS AND ASSEMBLIES FOR HANGING DEVICES

(75) Inventor: Mark A. Presser, Los Angeles, CA (US)

(73) Assignee: Presser International, LLC, Los Angeles, CA (US)

( * ) Notice: Subject to any disclaimer, the term of this patent is extended or adjusted under 35 U.S.C. 154(b) by 806 days.

(21) Appl. No.: 13/292,982

(22) Filed: Nov. 9, 2011

(65) Prior Publication Data

US 2013/0112721 A1 May 9, 2013

(51) Int. Cl.

| | |
|---|---|
| ***A41D 27/22*** | (2006.01) |
| ***A47G 25/14*** | (2006.01) |
| ***A47G 25/32*** | (2006.01) |

(52) U.S. Cl.

CPC ..... *A47G 25/1442* (2013.01); *A47G 25/32* (2013.01); *Y10S 223/04* (2013.01)

(58) Field of Classification Search

USPC ..... 223/85, 88, 92, 95, DIG. 4

See application file for complete search history.

(56) References Cited

U.S. PATENT DOCUMENTS

| | | | | | |
|---|---|---|---|---|---|
| 1,857,293 | A * | 5/1932 | Vroom | 16/87.8 |
| 2,499,188 | A * | 2/1950 | Freeman | 211/113 |
| 2,549,730 | A * | 4/1951 | Wassarman | 223/85 |
| 2,864,147 | A * | 12/1958 | Solow | 24/716 |
| 3,183,544 | A * | 5/1965 | Bailey | 16/18 R |
| 3,448,902 | A * | 6/1969 | Stebbins | 223/85 |
| 3,815,173 | A * | 6/1974 | Haussels | 16/45 |
| 4,783,880 | A * | 11/1988 | Chapman et al. | 16/45 |
| 5,050,833 | A * | 9/1991 | Usner | 248/340 |
| 6,530,120 | B2 * | 3/2003 | Samelson | 16/87.2 |
| 7,234,615 | B2 | 6/2007 | Presser et al. | |
| 7,243,822 | B2 | 7/2007 | Presser et al. | |
| 7,694,386 | B2 * | 4/2010 | Bushey et al. | 16/45 |

* cited by examiner

*Primary Examiner* — Nathan Durham

(74) *Attorney, Agent, or Firm* — Jonathan Jaech; Snell & Wilmer L.L.P.

(57) ABSTRACT

A friction reducing element for a hanging device includes a roller configured for positioning on an upper portion of a hook and a tubular elastomeric sleeve stretch-fitted over an outer surface of the roller. The roller is provided with a contoured outer surface and the sleeve is made from a thermoset elastomer such that the friction reducing element facilitates positioning of the hanging device, along a clothing rod. Use of the thermoset elastomer also prevents premature development of areas of deformation on the friction reducing element over time. The friction reducing element may be assembled into an upper portion of a hook for a clothes hanger, or other similar hanging device.

20 Claims, 3 Drawing Sheets

FRICTION REDUCING ELEMENTS AND ASSEMBLIES FOR HANGING DEVICES

BACKGROUND

1. Field

The present disclosure relates to friction reducing elements and assemblies for hanging devices, particularly devices used to hang garments and personal accessories.

2. Description of Related Art

Positioning garments and personal accessories hung on a conventional wire, plastic, wood, or metal hanger is often difficult for certain persons and under certain situations. For example, persons having limited upper body strength and disabled persons may find it difficult to slide hangers positioned on a rod. Moreover, heavy garments, such as winter coats and suits, are often difficult to position on a rod when hung on conventional hangers, even for persons without disabilities.

Hooks of conventional hangers can deform over time. Depending on the material of manufacture, conventional wire hanger hooks, in particular, can bend and conform to the shape of the clothing rod. As a result, the level of friction increases during positioning of hooks along the bar. Similarly, conventional plastic hangers can develop one or more areas of deformation or bends that can also make positioning items on a rod particularly difficult. Users of conventional hangers, therefore, encounter significant frictional resistance, when attempting to position hanger hooks along a rod.

Various products have been proposed to alleviate the difficulty of positioning garments and personal accessories hung on hangers. Although suitable for their intended purpose, each has limitations. Many of these limitations are due, in part, to the product's inability to withstand stress variations placed on hanger hooks.

A class of proposed products uses a thermoplastic roller positioned on a hanger hook. One such product in this class may include a roller formed from a thin flat strip of plastic material. The flat strip may be formed to provide a generally cylindrical roller conforming to the shape of a wire hanger, and the roller may be snap-fitted over a portion of a hanger hook. Another product may include a thermoplastic molded roller having a concave outer surface and mounted to the upper portion of a hanger hook using a bracket. Rollers in such products may be intended to accommodate rods of different sizes and lessen lateral forces required to move heavy items placed on hangers.

Unfortunately, positioning difficulty still arises with use of these types of rollers because they are manufactured from thermoplastic materials. Like conventional plastic hangers, these rollers may be prone to develop one or more areas of deformation over time, making garment positioning difficult. Such areas of deformation may create lasting flat spots in the rolling surfaces, causing uneven rolling during positioning. The deformation and resulting uneven rolling may be analogous to a hard rubber automobile tire left stationary for a long period. Under these circumstances, a tire may develop an area of deformation that appears flat, causing deformation and uneven rolling that increases rolling resistance and vibration.

In view of the limitations of these and other similar products, there is a clear need for improved friction reducing elements for hanging devices. The present invention fulfills this need and provides further related advantages, as described in the following summary.

SUMMARY

The present invention is directed to friction reducing elements for hanging devices. In one variation, a friction reducing element for a hanging device comprises a roller configured for positioning on an upper portion of a hook and a tubular elastomeric sleeve stretch-fitted over a contoured outer surface of the roller.

The roller is provided with a contoured outer surface, which facilitates movement of the roller on a positioning element, such as rods, belts, or bars of various shapes. The elastomeric sleeve comprises a thermoset elastomer that prevents premature development of areas of deformation on the roller during positioning of the hanging device. The elastomeric sleeve is configured as a unitary tubular element which is extruded from the thermoset material, cut to size, and then stretched-fitted over the roller.

The friction reducing element is positioned on a hook assembly that also includes a hook and a shell portion. A lower portion of the hook is coupled to a body for the hanging device. The body is able to support various items, including, among other things, garments, personal accessories, bags, meat products, household products, industrial products, and recreational products.

A more complete understanding of the friction reducing element and hook assemblies incorporating the friction reducing element will be afforded to those skilled in the art, as well as a realization of additional advantages and objects thereof, by consideration of the following detailed description. Reference will be made to the appended sheets of drawings which will first be described briefly.

DETAILED DESCRIPTION

Figure 1:
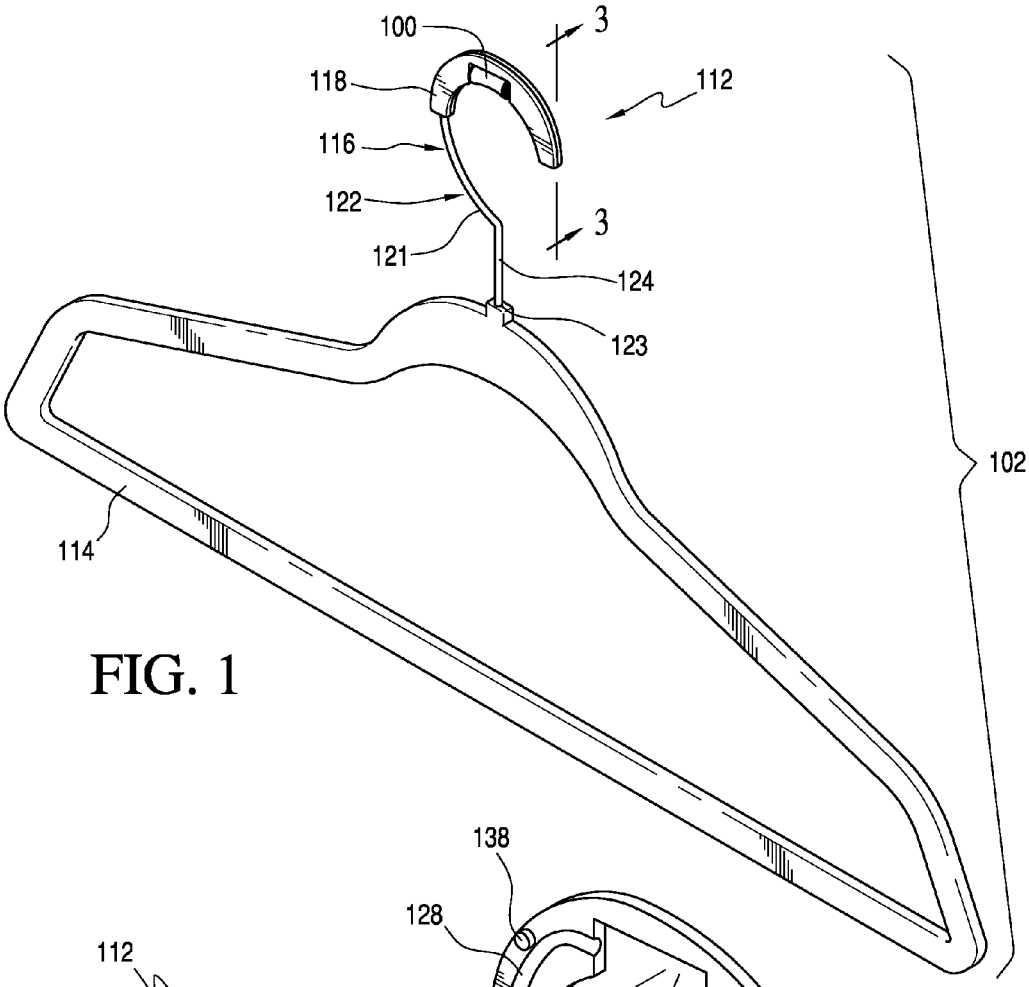
FIG. 1 is a perspective view of an exemplary hanging device having a hook assembly with a friction reducing element.

FIG. 1 shows an exemplary friction reducing element 100 positioned on a hanging device 102. The hanging device 102 is configured as a hanger, such as those used to hang garments and personal accessories. As used herein, however, the term "hanging device" should be broadly construed as any device that facilitates suspension and positioning of an item along a rod, bar, belt, or other type of positioning element. These positioning elements can have any cross-sectional configuration. Cross-sectional configurations include, but are not limited to, circular, oval, square, and rectangular configurations. Items that may be suspended and positioned on these positioning elements include, but are not limited to garments, personal accessories, bags, meat products, household products, industrial products, and recreational products.

Figure 4:
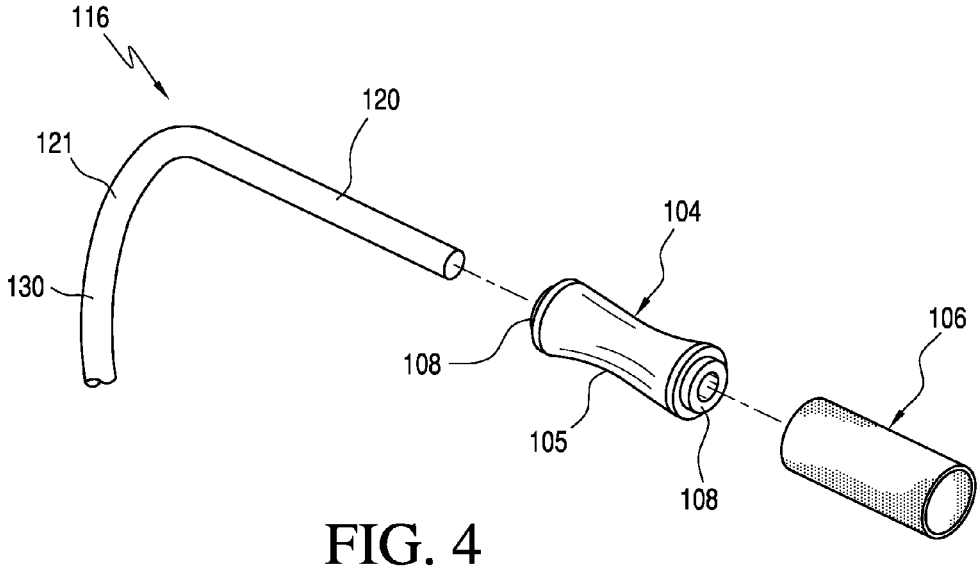
FIG. 4 is an exploded view of the friction reducing element and its positioning on an upper portion of a hook.

The friction reducing element 100 comprises a roller 104 and a tubular elastomeric sleeve 106, as particularly shown in FIG. 4. The roller 104 is configured for positioning on a portion of a hook 116, meaning that a portion of the hook is threaded through the inner diameter of the roller.

The roller 104 may comprise a thermoplastic material. Suitable thermoplastic materials may be as used in the manufacture of precision components. These materials should also have low frictional coefficients and dimensional stability. One type of thermoplastic material for roller manufacture is polyoxymethylene ("POM"), which is also known as acetal, polyacetal, and polyformaldehyde. Other suitable roller materials may include metal, stone, ceramic, sintered materials, fiber composites, or other structural materials. Using these materials, the roller 104 may be manufactured using any suitable and cost-effective method, including injection and compression molding.

Figure 5:
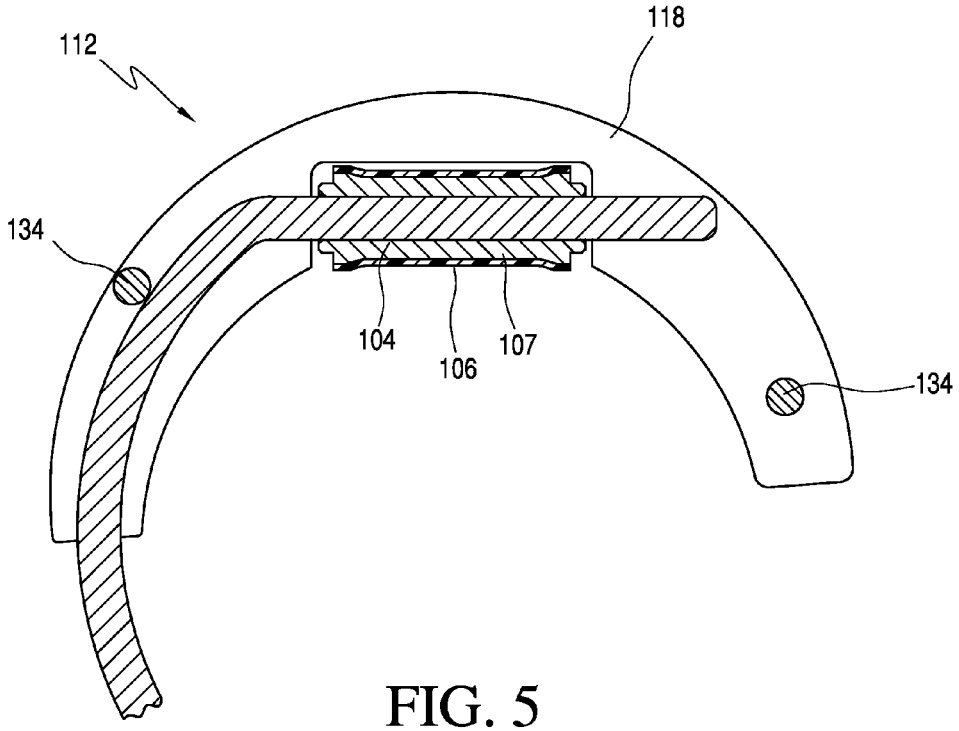
FIG. 5 is a cross-sectional view of another hook assembly, having a roller with an alternative contour.
Figure 6:
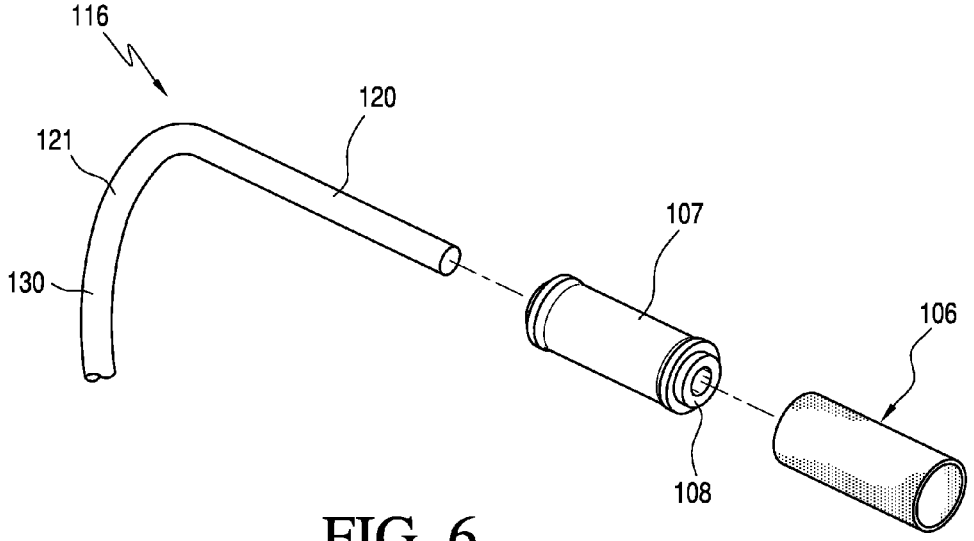
FIG. 6 is an exploded view of a friction reducing element, including the roller shown in FIG. 5, and its positioning on an upper portion of a hook.

The roller 104 may also be provided with a contoured outer surface 105 that facilitates movement of the roller 104 on a positioning element, such as a rod, bar, or belt. As used herein, a contoured outer surface should be broadly construed as any outer surface that is molded or shaped to conform to a positioning element and/or facilitate positioning of the roller over the positioning element. In one embodiment, the roller 104 may be concave as depicted particularly in FIGS. 3 and 4. In this embodiment, the roller may also be referred to as being concave cylindrical. In another embodiment, shown in FIGS. 5 and 6, the roller 104 may have an alternative contour, having a substantially straight cylindrical middle portion 107. In other embodiments (not shown), the roller may have a contoured outer surface that is neither straight cylindrical nor concave.

Where the friction reducing element is designed for use with a rod having a circular cross-section, the outer surface of the roller 104 may be concave with a smooth contour between end portions 108, as shown particularly in FIG. 4. For embodiments using a roller with a concave outer surface, an arc radius that facilitates positioning of the roller on the rod and decreases lateral force required for positioning may be specified. It should be appreciated that the roller 104 may be circularly symmetrical around its longitudinal axis, which in turn may be aligned with the longitudinal axis of the hook upper portion 120, to facilitate uniform rotation of the roller.

Optionally, the roller 104 may comprise ends portions 108. These end portions 108 provide additional support and positioning, as further described below. The end portions 108 may have greater diameters than the roller 104 diameter at the center portion located midway between the end portions 108.

The elastomeric sleeve 106 comprises a thermoset elastomer, having deformation resistance properties and a hardness so as to resist deformation, enable assembly of the sleeve over a roller core, and provide sufficient traction for rolling the roller over typical support bars. A suitable elastomer may be selected having a hardness in a range of about 50 to 95 Durometer Shore A, for example, in the range of 60 to 80 Durometer Shore A or about 70 Durometer Shore A, although the elastomer is not limited to these examples. Sleeves manufactured from thermoset elastomers, therefore, prevent premature development of areas of deformation on the roller during positioning of the hanging device. When left stationary for long periods, unlike thermoplastic hangers and concave rollers, the friction reducing element resists development of one or more areas of deformation. As a result, the hanging device remains balanced, allowing for even rolling and ease of positioning on a rod, bar, or other support structure. One exemplary material for use as an elastomeric sleeve is silicone rubber. Other suitable thermoset materials may include, for example, polyester, vinylester, polyurethane or phenolic resins. The sleeve is not limited to thermoset materials, and may be made of any suitable polymer, composite or other material meeting the application requirements as outlined above.

The elastomeric sleeve 106 may be configured as a unitary tubular element, as shown in FIG. 4. The sleeve has a uniform wall thickness and constant outer diameter prior to assembly. Before assembly, sleeve may have an overall length sufficient for covering at least a majority of the roller surface, and an outer diameter and wall surface for providing desired operational properties. For example, although not limited to the following examples or ranges, in many designs the sleeve may have a length ranging from about 12 to 25 mm, for example, about 17 mm, an outer diameter ranging from about 4 to 8 mm, for example, about 6 mm, and a wall thickness of about 0.5 to 1.0 mm, for example, about 0.75 mm. After assembly, the elastomeric sleeve has an amount of elastic strain that is proportional to the outermost circumferential surface of the roller. When the sleeve is fit over a concave roller, the wall thickness of the sleeve may be at a maximum near the center of the roller and decrease in thickness toward the ends of the roller, because of the sleeve conforming to a concave outer surface of the roller. More generally, an elastomeric tubular sleeve stretch fit over a cylindrical roller having a contoured surface may exhibit strain around its circumference that is proportional to the roller diameter, and correspondingly, a wall thickness in inverse proportion to the roller diameter. Thus, the strain and wall thickness of the elastomeric sleeve after installation over a roller of varying diameter may vary as a function of the roller diameter. The length, diameter and wall thickness may be adapted based on the material used to make the sleeve and the geometry of the roller that the sleeve is designed to fit over.

Figure 3:
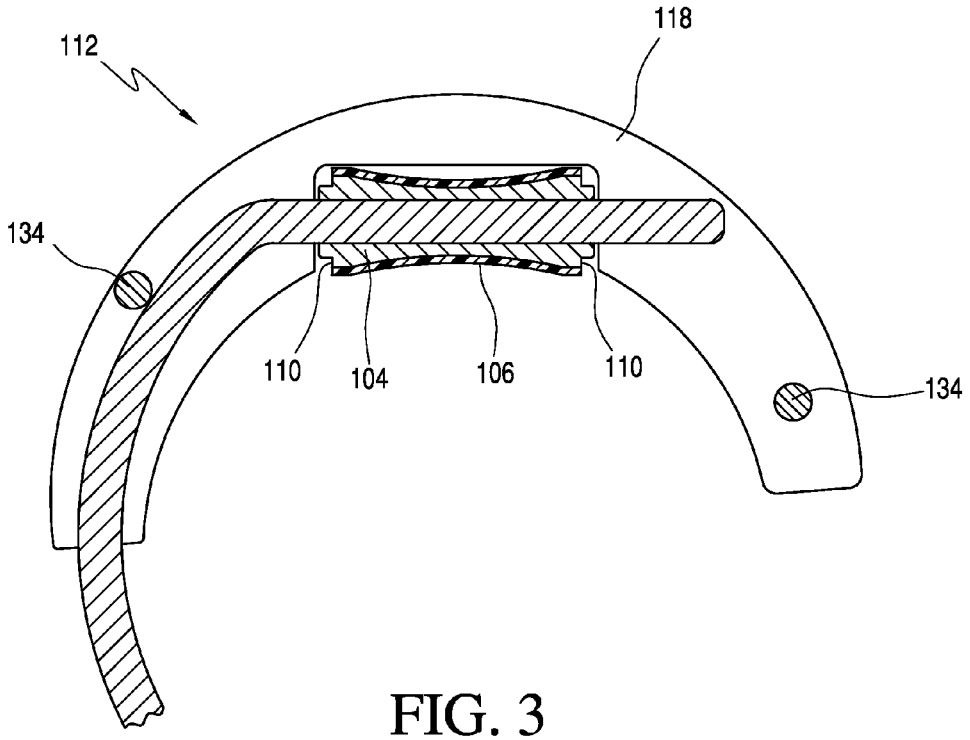
FIG. 3 is a cross-sectional view of the hook assembly shown in FIG. 1, taken along line 3-3.

The elastomeric sleeve may be extruded from an elastomeric material, cut to size, and then stretched to fit over the roller 104. The method used to stretch the elastomeric material over the roller may be automated or performed manually. When stretch-fitted over the roller, the sleeve 106 is positioned to substantially align with roller ends 110, as shown in FIG. 3. After the sleeve is positioned, the roller 104 is positioned within a hook assembly 112 included on the hanging device 102. Specifically, an upper portion of the hook is positioned within the inner diameter of the roller, as further described below.

The friction reducing element 100 may have a geometry adapted for its intended application. For example, when manufactured for use with a garment hanger, the friction reducing element 100 may have an overall length ranging from about 15 to 25 mm, for example, about 20 mm. The outermost diameter may range from about 5 to 9 mm, for example, about 7 mm, while the innermost diameter may range from about 1.5 to 5 mm, for example, about 3 mm. However, the friction reducing element 100 is not limited to having dimensions within the foregoing examples or ranges. The roller 104 may likewise have a geometry adapted for the friction reducing element 100. For example, for a garment hanger element, the overall length of the roller 104, excluding the end portions, may range from about 15 to 22 mm, for example, about 16 mm. For further example, if the end portions are included, the overall length of the roller may range from about 15 to 25 mm, for example, about 20 mm. The roller is not limited to these examples or ranges. As shown in FIG. 3, the wall thickness of the roller may vary, depending on the contour of the outer surface. In contrast, the wall thickness of the end portions may be generally uniform throughout its length, where the length of the end portions generally may range from about 0.5 to 3 mm, for example, about 1 mm, without being limited to these dimensions.

The hanging device 102 may comprise the hook assembly 112 and a body 114 for support of suspension items. The hook assembly 112 includes the friction reducing element 100, a hook 116, and a shell portion 118. The hook 116 has an upper portion 120 that couples to the friction reducing element 100 and a lower portion 122 having a curved section 121 and a substantially vertical section 124. The curved section 121 may be configured with a shape or curvature that facilitates positioning of the hook on a clothing rod, belt, or other type of positioning element (not shown). The substantially vertical section 124 couples with the body 114. In one variation, the body 114 is provided with an opening 123 that is sized to adhere to or press-fit with the substantially vertical section 124.

The hook 116 may comprise a plastic material, composite material, a metal material, or any suitable combination of these or other materials. The hook may also be provided with a thin and uniform cross-section that facilitates entry of upper portion 120 into the friction reducing element 100. The upper portion 120 of the hook 116 is substantially horizontal and configured to terminate at a specified point within the shell portion 118, as further described below.

Figure 2:
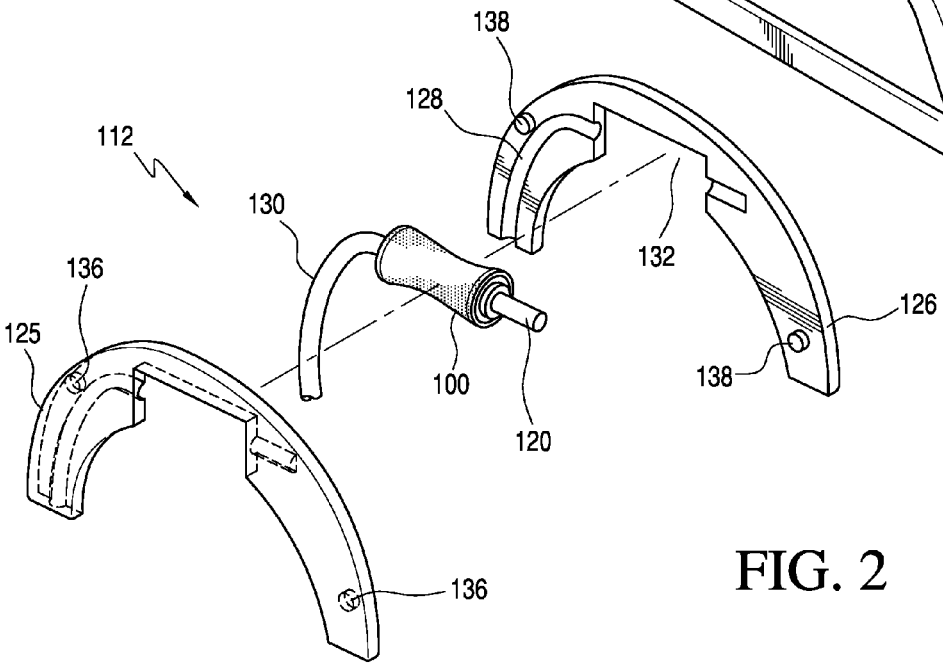
FIG. 2 is an exploded view of the hook assembly shown in FIG. 1.

In one configuration, the shell portion 118 comprises a front shell section 125 and a rear shell section 126. Alternatively, the shell portion may be unitary and configured for positioning over the hook. In the configuration shown in FIG. 2, the shell portion, shown in FIG. 2 as two separate elements 125, 126, is provided with recessed sections 128 that conform to the shape of the upper portion of the hook. The recessed sections thereby allow the upper portion 120 to terminate at a specified point within the body of the shell portion 118 and retain the roller 104 on the upper hook portion 120. The recessed sections 128 also conform to a partial section 130 of the lower portion 122. The shell portion further includes one or more relief sections 132 for the friction reducing element 100.

The shell portion 118 may also include mating snap elements 134, where each element 134 has a snap recess 136 and a snap protrusion 138. Upon assembly, the shell portion 118 positions the upper portion 120 of the hook and the friction reducing element 100, as shown in FIG. 3. The end portions 108 also abut the shell portion 118 such that the friction reducing element 100 may roll evenly during positioning of the hanging device 102.

The shell portion 118 may comprise a plastic material, composite material, a metallic material, or any suitable combination of these or other structural materials. In one configuration, the shell portion 118 comprises thermoplastic material such as acrylonitrile butadiene styrene ("ABS").

While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. A friction reducing element for a hanging device, comprising:

a generally cylindrical roller having a maximum diameter within 5 to 9 mm and a length within 15 to 25 mm, made of a dimensionally stable material selected from the group consisting of a structural polymer, metal, stone, ceramic, sintered material or fiber composite, and configured for rotatable mounting on an upper portion of a hanger hook; and a tubular elastomeric sleeve of hardness within 60 to 80 durometer, Shore A and wall thickness within 0.5 mm to 1.0 mm, stretch-fitted over a contoured outer surface of the roller and covering at least all portions of the roller having the maximum diameter.

2. The friction reducing element of claim 1, wherein the elastomeric sleeve comprises a thermoset elastomer.

3. The friction reducing element of claim 1, wherein the elastomeric sleeve comprises an elastomer having a hardness of about 70 durometer, Shore A.

4. The friction reducing element of claim 1, wherein the elastomeric sleeve comprises silicone.

5. The friction reducing element of claim 1, wherein the elastomeric sleeve is a unitary cylindrical member of elastic material.

6. The friction reducing element of claim 1, wherein the contoured outer surface of the roller is concave cylindrical.

7. The friction reducing element of claim 1, wherein the roller comprises polyoxymethylene.

8. The friction reducing element of claim 1, wherein the roller further comprises end portions having the maximum diameter greater than a diameter of a central portion of the roller.

9. A hook assembly for a hanging device, comprising:

a cylindrical roller having a maximum diameter within 5 to 9 mm and a length within 15 to 25 mm, made of a dimensionally stable material selected from the group consisting of a structural polymer, metal, stone, ceramic, sintered material or fiber composite;

and a tubular elastomeric sleeve of hardness within 60 to 80 durometer, Shore A and wall thickness within 0.5 mm to 1.0 mm, stretch-fitted over an outer surface of the roller and covering at least all portions of the roller having the maximum diameter;

a hook having a straight cylindrical upper portion passing through the cylindrical roller and a lower portion having a curved section and a substantially vertical section for coupling to a hanger body; and a shell containing the upper portion except where the roller is positioned, partially or fully containing the lower portion, and positioning the cylindrical roller in rotatable relation to the straight cylindrical upper portion of the hook.

10. The hook assembly of claim 9, wherein the elastomeric sleeve comprises a thermoset elastomer.

11. The hook assembly of claim 9, wherein the elastomeric sleeve comprises an elastomer having a hardness of about 70 durometer, Shore A.

12. The hook assembly of claim 9, wherein the elastomeric sleeve comprises silicone.

13. The hook assembly of claim 9, wherein the elastomeric sleeve is a unitary cylindrical member of elastic material.

14. The hook assembly of claim 9, wherein the outer surface of the roller is concave cylindrical.

15. The hook assembly of claim 9, wherein the roller comprises polyoxymethylene.

16. The hook assembly of claim 9, wherein the roller further comprises end portions having the maximum diameter greater than a diameter of a central portion of the roller.

17. The hook assembly of claim 9, wherein the shell portion comprises acrylonitrile butadiene styrene.

18. A hanger, comprising:

a body and a hook assembly, the hook assembly comprising:

a friction reducing element comprising a cylindrical roller having a maximum diameter within 5 to 9 mm and a length within 15 to 25 mm, made of a dimensionally stable material selected from the group consisting of a structural polymer, metal, stone, ceramic, sintered material or fiber composite and a tubular elastomeric sleeve of hardness within 60 to 80 durometer, Shore A and wall thickness within 0.5 mm to 1.0 mm, stretch-fitted over an outer surface of the roller and covering at least all portions of the roller having the maximum diameter;

an upper hook portion passing through the cylindrical roller;

a lower hook portion having a curved section and a substantially vertical section coupled to a hanger body; and a shell containing the upper portion except where the roller is positioned, partially containing the lower portion, and retaining the friction reducing element in a rotatable mount to the upper hook portion.

19. The hanger of claim 18, wherein the elastomeric sleeve comprises a thermoset elastomer.

20. The hanger of claim 18, wherein the elastomeric sleeve comprises an elastomer having a hardness of about 70 durometer, Shore A.

* * * * *